US006045449A

United States Patent [19]

Aragona et al.

[11] Patent Number: 6,045,449

[45] Date of Patent: Apr. 4, 2000

[54] WATER PINBALL RIDE WITH SPECTATOR INTERACTION

[76] Inventors: Mark Aragona, R.R. 1 Box 89F, Cornwallville, N.Y. 12418; Robert F. Belongia, 11427 Laurel View Dr., Charlotte, N.C. 28273; Fred C. Larson, 12 Woodlate Rd. Apt.#3, Albany, N.Y. 12203

[21] Appl. No.: 09/034,047

[22] Filed: Mar. 3, 1998

[51] Int. Cl.[7] ..... A63G 21/18

[52] U.S. Cl. ..... 472/117; 472/13; 472/128

[58] Field of Search ..... 472/117, 128, 472/13, 88, 129; 104/70, 73, 53, 59

[56] References Cited

U.S. PATENT DOCUMENTS

| | | | |
|---|---|---|---|
| 1,218,200 | 3/1917 | Maynes . | |
| 1,701,842 | 2/1929 | Fisch . | |
| 3,210,077 | 10/1965 | Hjelte . | |
| 3,675,927 | 7/1972 | Gottlieb et al. . | |
| 3,964,316 | 6/1976 | Abe . | |
| 4,805,897 | 2/1989 | Dubeta . | |
| 4,836,521 | 6/1989 | Barber | 472/128 |
| 4,865,311 | 9/1989 | Beekenkamp . | |
| 5,069,443 | 12/1991 | Shiratori . | |
| 5,219,315 | 6/1993 | Fuller et al. | 472/59 |
| 5,230,662 | 7/1993 | Langford . | |
| 5,378,197 | 1/1995 | Briggs | 472/128 |
| 5,453,054 | 9/1995 | Langford | 472/117 |
| 5,704,294 | 1/1998 | Van Winkle et al. | 104/73 |
| 5,716,282 | 2/1998 | Ring et al. | 472/117 |
| 5,738,590 | 4/1998 | Lochtefeld | 472/117 |

*Primary Examiner*—Kien T. Nguyen
*Attorney, Agent, or Firm*—Marger Johnson & McCollom, P.C.

[57] ABSTRACT

A water play area having a plurality of water devices and actuators for controlling those devices located outside of the play area for selective activation by spectators observing participants within the play area. The play area is preferably laid out like a giant pinball machine in which participants are placed in groups or individually within tubes representing the balls of the pinball machine. Movement of the tubes along the play area plane can be influenced by movement inducing devices such as flippers, spinners, stationary bumpers, guides and Dutchman's Dikes. Also included within the play area are water devices, such as whipping snakes, geysers, rain drops, shower sprayers, whirly-birds and water bomb launchers that can either be on continuously or be selectively activated to drench participants within the play area.

21 Claims, 10 Drawing Sheets

WATER PINBALL RIDE WITH SPECTATOR INTERACTION

BACKGROUND OF THE INVENTION

This invention relates generally to water-based rides and more particularly to such a ride that allows spectators to interact with the water ride participants.

The phenomenal growth of water parks in the past few decades has witnessed an evolution in water-based attractions. In the '70s and early '80s, these water attractions took the form of slides from which a participant started at an upper pool and slid by way of gravity passage down a serpentine slide upon recycled water to a lower landing pool. U.S. Pat. No. 3,923,301 to Meyers discloses such a slide dug into the side of a hill. U.S. Pat. Nos. 4,198,043 to Timbes and 4,196,900 to Becker et al. disclose such slides supported on a structure. Each of these slides only allowed essentially one-dimensional movement from the upper pool, down the slide to the lower pool. Consequently, the path taken down the slide always remained the same thus limiting the sense of novelty and the unexpected for the participant after multiple uses.

Cognizant of this limitation in traditional water slides, new water attractions were developed which inserted a little more of the element of chance during the ride. One such attraction has up to twelve people seated within a circular floating ring being propelled down a flume comprising a series of man-made rapids, water falls and timed water spouts. As the floating ring moves down the path of the water attraction, contact with the sides of the flume cause the ring to rotate thus moving certain people in closer proximity to the "down-river" side of the rapids, the water falls and the spouts. Those people who were closest to such features of the water ride tended to get the most wet. Since such movement was determined mostly by chance, each participant had an equal chance of getting drenched throughout the ride by any one of the many water ride features.

This later type of ride, though an improvement over the traditional water slide, was still essentially a one-dimensional travel from an upper start area down to a lower start area where all features came into play. Furthermore, each of these features were either continuously active (such as the water fall) or automatically activated by the proximity of the floating ring to the feature.

The popularity of these types of rides has resulted in very long lines at such water parks. Spectators, such as those waiting in line for the water ride, could not interact (except verbally) with those participants on the ride. Consequently, the lasting memory at such parks may not very well be the rides at the park but the long lines and waiting required to use the rides.

Accordingly, a need remains for a type of water ride that entertains the spectator as well as the participant.

SUMMARY OF THE INVENTION

It is, therefore, an object of the invention to enable spectators outside of the water play ride area to interact with those participants who are within the play area.

Another object of the invention is to give such spectators control over certain elements of the water ride.

A further object of the invention is to provide a water play area that allows two dimensional movement across the area and not simply movement from an upper area to a lower area.

To enable these objects, a water ride constructed according to the present invention comprises a water play area having a plurality of water devices and actuators for controlling those devices located outside of the play area for selective activation by spectators observing participants within the play area. The play area is preferably laid out like a giant pinball machine in which participants are placed in groups or individually within tubes representing the balls of the pinball machine. Movement of the tubes along the play area plane can be influenced by movement inducing devices such as flippers, spinners, stationary bumpers, guides and Dutchman's Dikes. Also included within the play area are water devices, such as whipping snakes, geysers, rain drops, shower sprayers, whirly-birds and water bomb launchers that can either be on continuously or be selectively activated to drench participants within the play area.

Once seated within the tubes, the participants are "launched" from an upper end of the play area and proceed generally downward toward a splash pool at a lower end of the play area. Some of the movement inducing devices could be selectively actuated by a spectators located outside of the play area to propel the tubes of the participants in a direction desired by the spectator. Thus, for instance, a spectator can choose to selectively activate a flipper at the proper moment to thus propel a tube toward, for instance, a water shower whereupon another spectator can activate the water shower at the proper moment to drench the participant(s) within the tube.

The advantages of such a system are threefold. First, spectators are entertained as well as the participants by allowing spectators to affect the outcome of the water ride for the participants within in. Second, such a ride would be simpler to operate since the spectators themselves could activate the effects at the proper time rather than requiring extra staff or precisely timed automation. It is understood that such effects could be operated under computer control if the effect has not been activated by a spectator after a certain preset time period. Third, a pinball-type layout, including movement inducing devices and water devices, would allow movement in two dimensions thus increasing the novelty of the water ride even after multiple uses.

The foregoing and other objects, features and advantages of the invention will become more readily apparent from the following detailed description of a preferred embodiment of the invention which proceeds with reference to the accompanying drawings.

BRIEF DESCRIPTION OF THE DRAWINGS

FIG. 10 is a sectioned side view of the device of FIG. 9 shown coupled to an actuator.

DETAILED DESCRIPTION OF THE DRAWINGS

Figure 1:
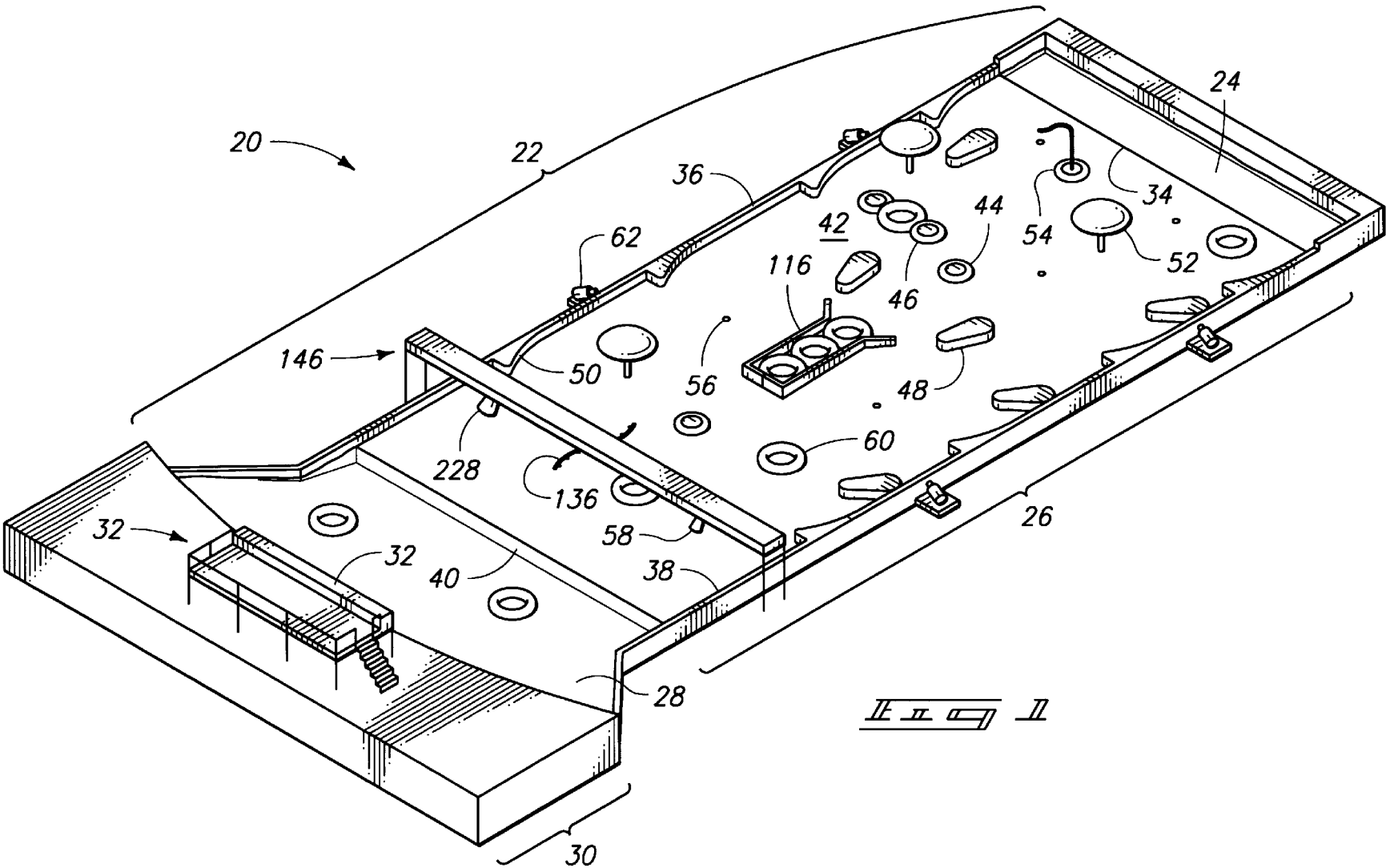
FIG. 1 is a perspective view showing an interactive water ride constructed according to a preferred embodiment of the invention.

The preferred embodiment of the pinball-type water ride constructed according to the present invention is shown generally at 20 in FIG. 1. The pinball-type water ride generally includes a participant play area 22 having an upper start pool 24, a sloped playing field 26 and a lower splash pool 28. The ride also includes a spectator area 30 having a raised platform 32 overlooking the playing field 26 on which a control panel is formed from which certain designated movement inducing features and water effects (described in detail below) are selectively activated.

Figure 2:
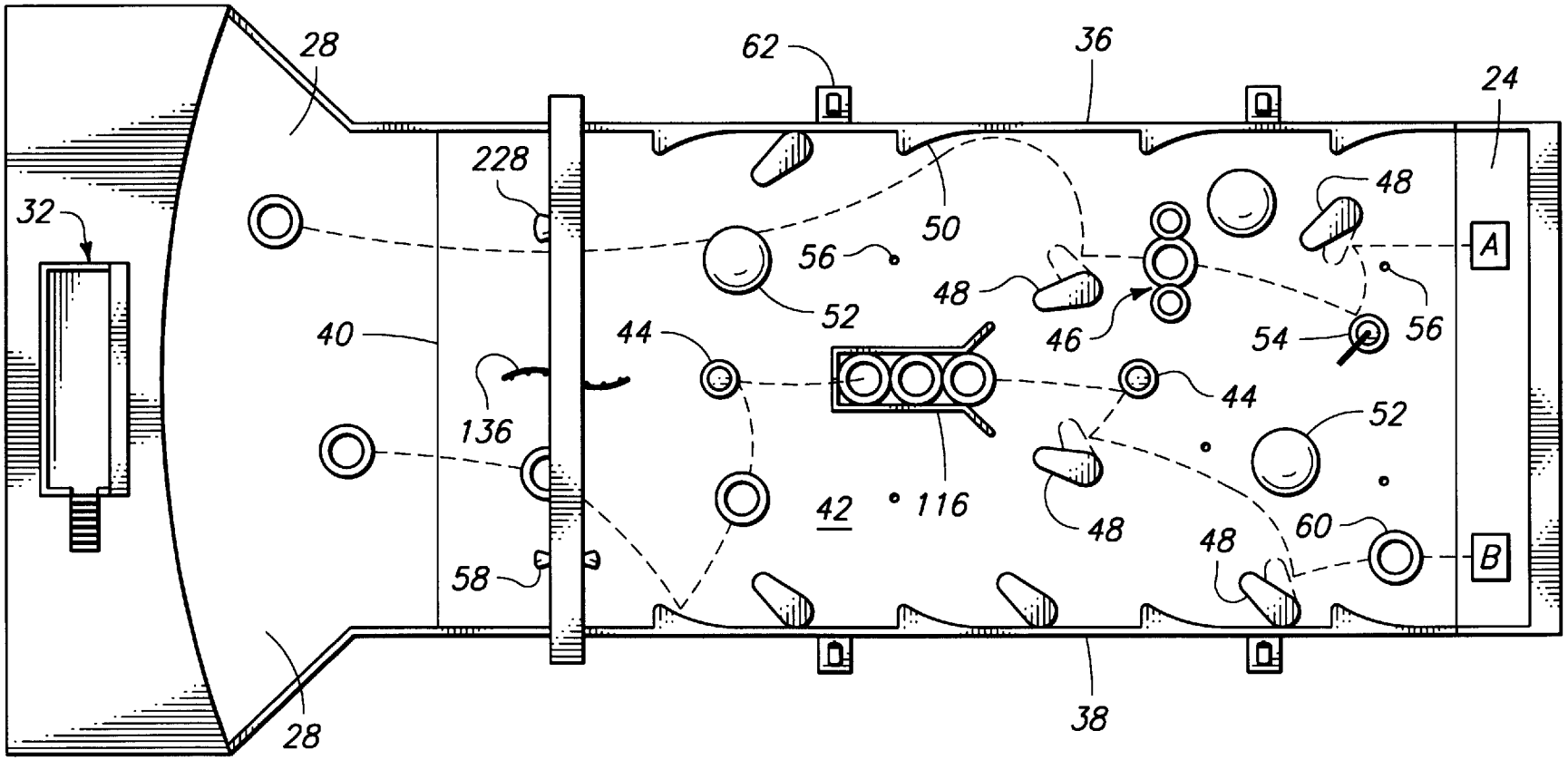
FIG. 2 is a top plan view of the water ride of FIG. 1.

FIGS. 1 and 2 illustrate perspective and top plan views, respectively, of the pinball-type water ride 20 constructed according to a preferred embodiment of the invention. Water ride 20 is designed to simulate the famous pinball machine on a much larger scale in which the sloped playing field 26 is approximately fifty feet wide by one-hundred and fifty feet long. These dimensions, of course, can be adapted to fit the location in which the water ride is constructed.

The playing field 26 is bounded by a top edge 34 adjacent the upper start pool 24, raised side edges 36,38 and a bottom edge 40 adjacent the lower splash pool 28. The playing field 26 generally comprises a sliding surface 42 formed of a slick material such as fiberglass or coated concrete that is gradually sloped (e.g. approximately 7%) from the top edge 34 of the playing field 26 to the bottom edge 40. Located on the sliding surface are movement inducing devices, similar to a typical pinball machine, including stationary bumpers 44, spinners 46, flippers 48, guides 50 and other devices described in detail below. Also included within the playing field are water features such as rain drops 52, whipping snakes 54, geysers 56, shower sprayers 58 and other such features described in detail below.

The upper start pool 24 is continuously fed water by a pump (not shown) to a level just above the level of the top edge 36 so that a sheet of water spills over the top edge 36 and down the sliding surface 42 to the lower splash pool 28. In one embodiment of the upper start pool 24, for instance, a wave generator adjacent to the pool can move water within the pool in waves to provide waves of propulsion down the sliding surface 42. The lower splash pool 28 serves as a landing area to signify the end of the water ride. In one embodiment of the lower splash pool 28, for instance, the water level of the pool is a few feet below the bottom edge 40 of the sliding surface 42 so that the feeling of moving down a water fall is simulated when participants fall from the bottom edge of the sliding surface into the splash pool a few feet lower.

Instead of using a metal ball as in conventional pinball machines, participants are placed individually or in groups in circular vehicles, such as air-filled inner tube 60, and "launched" from the upper start pool 24 located along the top edge 34 of the sloped playing field 26. Because the sliding surface 42 is much wider than the diameter of tube 60, participants can launch their tube anywhere along the width of top edge 34 so that different devices and features within the playing area can be brought into play. In this way, the playing area 26 is two-dimensional.

Movement of participants to the upper start pool 24 to begin the ride can be accomplished in several ways. First, participants could simply climb stairs or move on a path from the lower splash pool area 28 to the upper start pool area 24. From there, participants would be seated within one of the tubes stored adjacent the upper start pool and then begin their journey down the water ride. Alternately, the tubes could be conveyed to the upper start pool from the lower pool by such means as a conveyor belt to ensure an adequate supply of tubes at the upper start pool. Finally, tubes from the lower splash pool can be moved to an adjacent flume, the participants seated within the tube, and water jets along the flume used to propel the tube up the flume toward the start pool area 24 similar to the way in which a pinball is put into play in a pinball machine.

Many tubes may be on the ride at any given time. The tubes may even bump into one another. Since the object of the present invention is to add excitement via water-related activities, there will be showers of many designs scattered about the slide. There will be cohesive water jet "missiles" launched from the perimeter (e.g. from water bomb launcher 62) and landmines or geysers that can "explode" a shower of water spray (e.g. from geyser 56) in a nearby radius, hose jets, shower sprayers, etc. scattered across the playing area. Each device mounted on the sliding surface 42 that would have the potential for impact will be surrounded by a soft cushion to absorb shock. The cushion could come in several forms, the most common of which would be air bladders or foam rubber. The flippers, such as flipper 48, will actually move, but unlike the small pinball machines, they will move gracefully, offering the participants a gentle bump in another direction. Some more expensive designs may have bells and sirens that sound upon impact of the inner tubes on the bumpers, flippers and other devices.

These devices can be controlled by spectators at the remote master control panel located nearby the ride, such as on a platform 32 overlooking the playing field 26. The spectators, standing before these remote controls, are not riding on the ride at the time they are at the control panel, but are instead interacting with the participants by selectively activating the movement inducing devices and water features. This interaction between participants and spectators within the water ride is referred to herein as "spectator interface." The controls used at the control panel can be in the form of large buttons, wheels, chains, joysticks, levers, etc. For instance, when a button is depressed, it sends a signal to a hydraulic piston that is then caused to stroke. The piston is connected to a flipper assembly, causing the flipper to stroke and bump a nearby tube of participants. Each device on the ride can have a remote control feature that will activate the device. The signals conveying the message to the devices can come in the form of pneumatic, hydraulic or electric power, or any combinations. Joysticks can be used to control the aiming of devices in certain planes to allow the spectators to hone in on a particular target.

Figure 3:
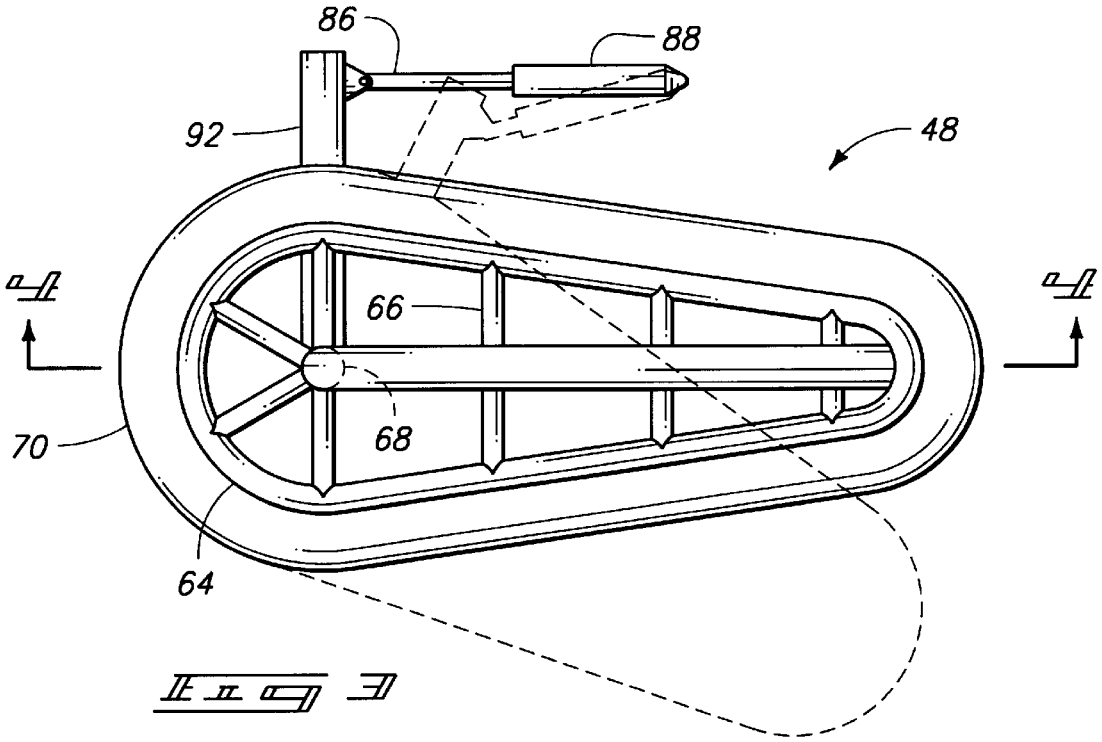
FIG. 3 is a top view of a first movement inducing device called a "flipper."
Figure 4:
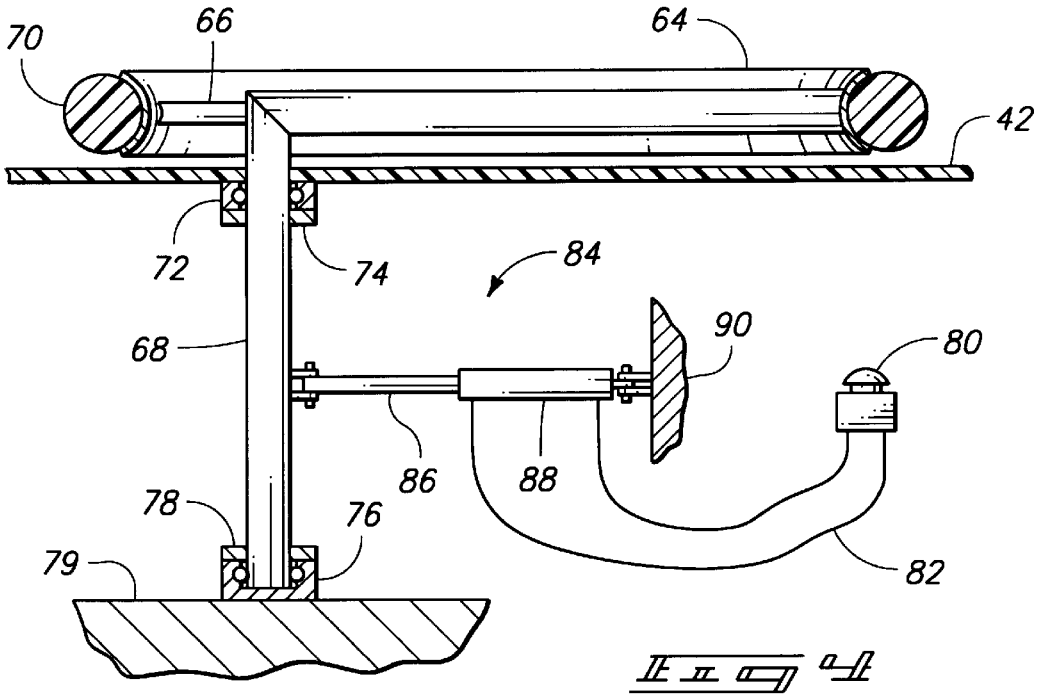
FIG. 4 is a sectioned side view of the device of FIG. 3 shown coupled to an actuator.

FIGS. 3 and 4 illustrate a first movement inducing device at 48 that can be included in the pinball-type water ride. Device 48 is patterned after a flipper device of a pinball machine, and is hereinafter referred to as a flipper paddle. The flipper paddle of the present invention includes an elongate rigid inner frame comprised of a steel rim 64, a supporting inner truss frame 66, a pivoting axle 68 upon which the flipper paddle rotates, and a shock absorbing layer 70 coupled to the outer edge of rim 64. The pivoting axle 68 is attached to the inner truss frame 66 closer to a back end thereof so that the flipper paddle rotates asymmetrically to enable the front end of the flipper paddle to move along an arc to an activated position shown in dashed lines. Layer 70 can be an air inflated bladder, a solid foam rubber cushion or like element that is adapted to cushion the shock when the flipper paddle 48 contacts the participant's inner tube 60.

FIG. 4 shows a sectioned side elevation of the flipper paddle 48. The axle is shown offset from the center of the flipper to allow pivoting movement of the front end of the flipper through an arc as shown in FIG. 3. The axle 68 passes through the sliding surface 42 of the sloped playing field and into a space below it. An upper bearing collar 72 and thrust collar 74 are affixed to the underside of the sliding surface 42 at the upper end of the space. A lower bearing collar 76 and thrust collar 78 are affixed to the floor 79 at the lower end of the space in axial alignment with the upper bearing collar 72 and thrust collar 74. The axle is received within collars 72,74,76 and 78, thus fixing the vertical axis of the axle 68 within the space. The upper bearing collar 72 and lower bearing collar 76 include a cylindrical aperture surrounded by ball bearings to facilitate rotational movement of the axle within the collars.

Rotation of the flipper paddle is induced first by spectator activation of a remote control button 80 located at a master control panel outside of the participant area of the water ride. The control button is coupled by such means as wires 82 to a hydraulic actuator 84. Actuator 84, formed of such means as a rod 86 and piston 88, extends laterally across the space below the sliding surface 42 between a fixed lateral surface 90 and a lever arm 92 (shown best in FIG. 3).

The button 80 can be a simple momentary switch such that the hydraulic actuator 84 shortens in response to electric signals received through wires 82 from the activated button 80. As the hydraulic actuator 84 shortens, the lever arm 92 (offset from the vertical axis of the axle 68) is moved clockwise thus gradually rotating that portion of the paddle flipper above the sliding surface 42 to the position shown in dashed lines in FIG. 3. The hydraulic actuator can then be moved back to its original extended position in response to a further activation of button 80 or, alternately, can return the flipper paddle to its original position after a certain time has elapsed.

Alternately, the button 80 can be a dial-type in which the length which the hydraulic actuator is shorted and the consequent arc angle through which the flipper paddle 48 is moved is regulated by the selected arc chosen at the dial-type remote button. For instance, it would be desired to move a flipper paddle located within the central portion of the play area both clockwise and counter clockwise depending upon which side the inner tube passes by the paddle. A spectator could then rotate the paddle to the clockwise if the inner tube is passing by the left and counter-clockwise if passing by the right. The preferred range of motion of the flipper paddle is from about 0 to 30 degrees from resting position.

Figure 5:
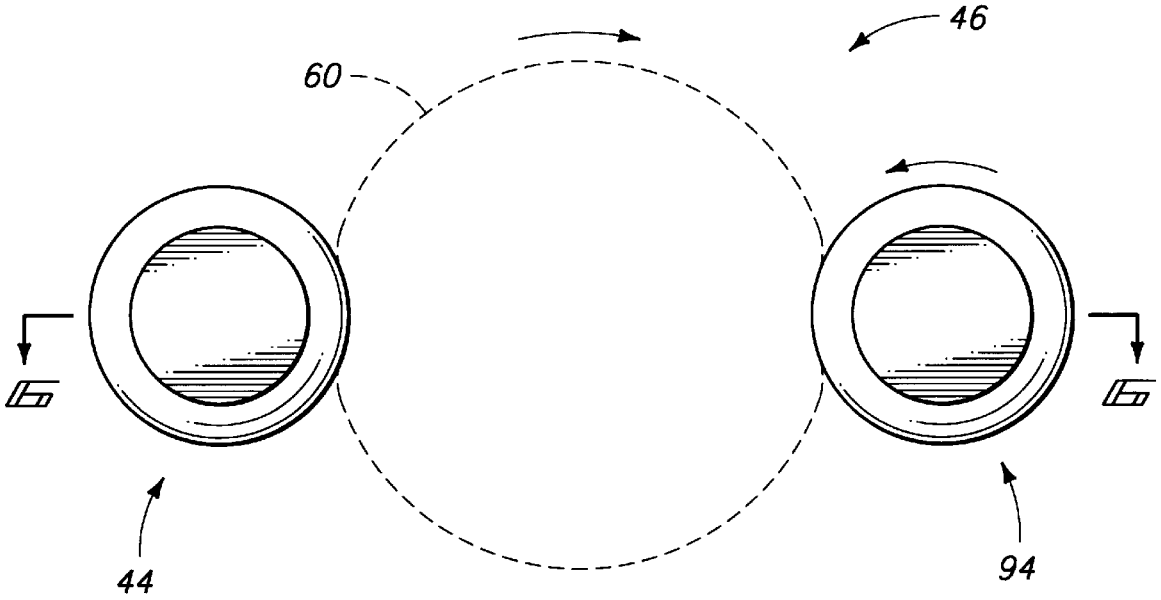
FIG. 5 is a top view of a second movement inducing device called a "spinner."
Figure 6:
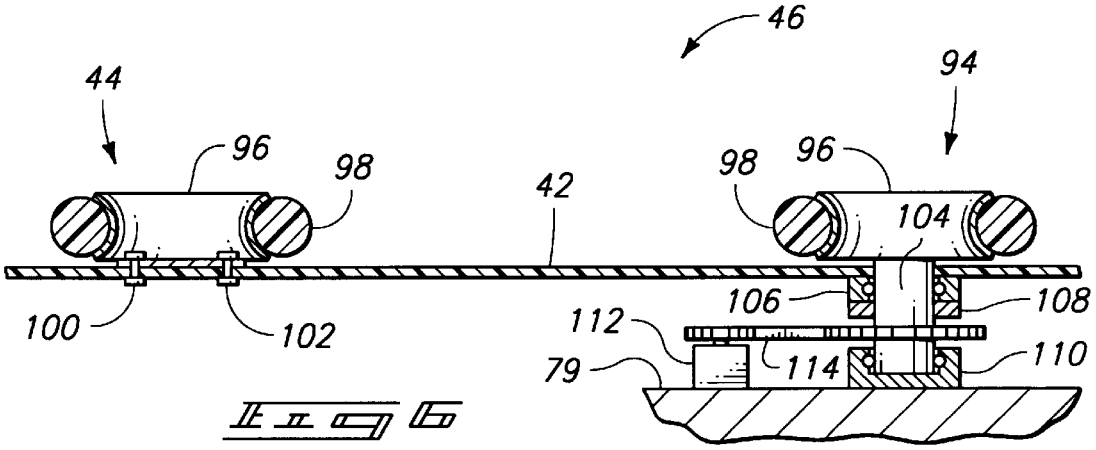
FIG. 6 is a sectioned side view of the device of FIG. 5.

FIGS. 5 and 6 illustrate a second embodiment of a movement inducing device at 46 for use within the participant's playing area of the water ride. The device, herein referred to as a "spinner", includes a stationary bumper 44 in combination with a rotating bumper 94, wherein the outer surfaces of bumpers 44,94 are separated by a distance slightly less than the diameter of the inner tube 60 shown in dashed outline in FIG. 5.

Referring particularly to FIG. 6, the stationary bumper 44 includes a rigid inner rim 96 surrounded by a shock absorbing layer such as air bladder 98. Bumper 44 is affixed to the sliding surface 42 of the playing area via one or more anchor bolts, such as bolts 100,102.

Spinning bumper 94 includes a similar rigid inner rim 96 and air bladder 98 as the fixed bumper 44. An axial shaft 104 attached centrally to the rim of the spinning bumper 94 passes through the sliding surface 42 of the playing area and into a space below the surface. An upper bearing collar 106 and thrust collar 108 are affixed to the underside of the sliding surface 42 at the upper end of the space. A lower bearing collar 110 is affixed to the floor 79 at the lower end of the space in axial alignment with the upper bearing collar 106 and thrust collar 108. The axle is received within collars 106,108 and 110, thus fixing the vertical axis of the axle 68 within the space. The upper bearing collar 106 and lower bearing collar 110 include a cylindrical aperture surrounded by ball bearings to facilitate rotational movement of the axial shaft 104 within the collars. A drive motor 112 mounted within the space engages and rotates axial shaft 104 through known means such as a drive chain 114. Although FIGS. 5 and 6 do not show the spinner 46 coupled to an actuator, it is understood that such an actuator (accessible by a spectator) could be coupled to the drive motor 112 to, for instance, vary the speed of rotation of the spinning bumper 94.

When inner tube 60 squeezes between bumpers 44,94, the rotation of bumper 94 imparts a spin to the inner tube 60 opposite the direction of rotation of bumper 94. For instance, as shown in FIG. 5, the inner tube 60 will have a clockwise rotation imparted to it from the counter-clockwise rotating bumper 94. It is envisioned that a second rotating bumper could be used in place of the stationary bumper 44 which rotates in the opposite direction as rotating bumper 94. An inner tube passing between such oppositely rotating bumpers would be shot out from the two bumpers at high speed depending upon the speed at which the bumpers are rotating. If the speed of one of the rotating bumpers differs from the other, the inner tube will also have spin imparted to it in addition to speed.

Figure 7:
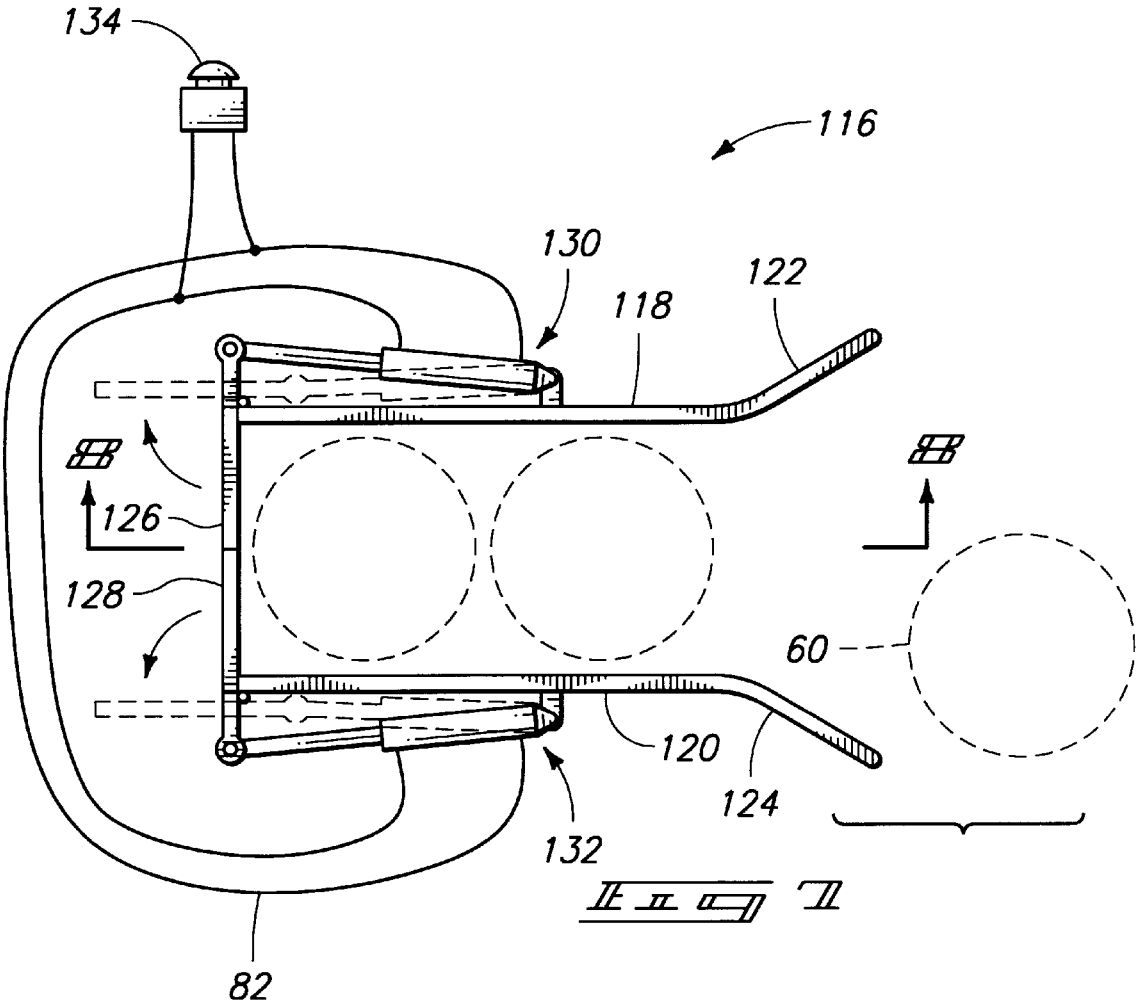
FIG. 7 is a top view of a third movement inducing device called a "Dutchman's Dike" shown coupled to an actuator.
Figure 8:
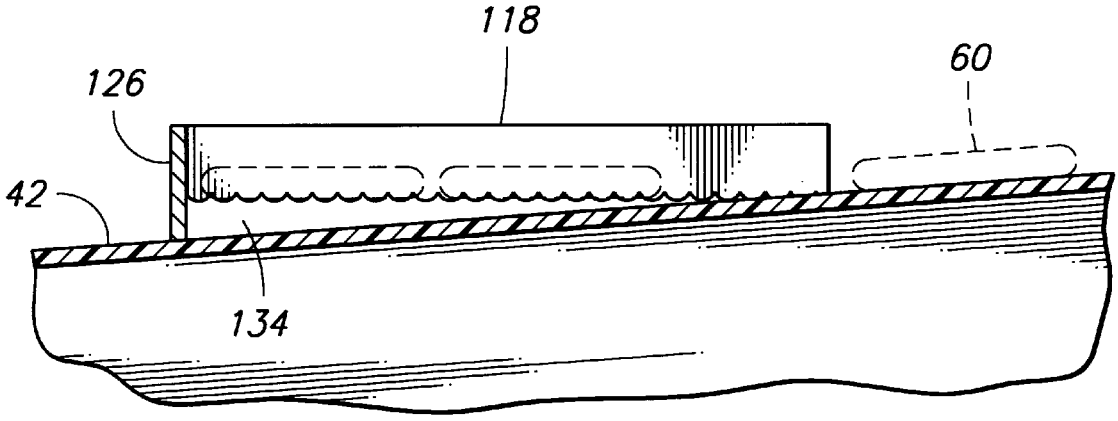
FIG. 8 is a sectioned side view of the device of FIG. 7.

FIGS. 7 and 8 illustrate a third embodiment at 116 of a movement inducement device for use with the water play device of the present invention. It is understood that the sliding surface 42 slopes downward from right to left in FIGS. 7 and 8 thus defining the right edge as the upstream side and the left edge as the downstream side. Movement inducing device 116, hereinafter referred to as a "dutchman's dike", includes opposing walls 118,120 having respective guide portions 122,124 at upstream ends thereof. Guide portions 122,124 are adapted to guide inner tubes 60 to a space between the opposing walls 118,120. Swing doors 126,128 are located adjacent the downstream ends of walls 118,120 to thereby define a space enclosed on three sides.

Swing doors 126,128 are pivotally connected to one end of respective hydraulic actuators 130,132 and further pivotally connected to respective opposing walls 118,120. When the doors 126,128 are in the closed position, water guided between walls 118,120 of the dutchman's dike are stopped from flowing out the downstream end of the dike. Consequently, the water level 134 of the dike rises thus floating a plurality inner tubes within the dike. Actuators 130,132 are coupled by means such as wires 82 to a remote control button 134 located at a master control panel outside of the participant play area of the water ride. When the spectator depresses the remote control button 134, the hydraulic actuators 130,132 activate and decrease their length, thus pulling the doors 126,128 open (to an opened position shown in dashed lines). As the doors open, all inner tubes 60 within the dike flush out on a wave.

Figure 9:
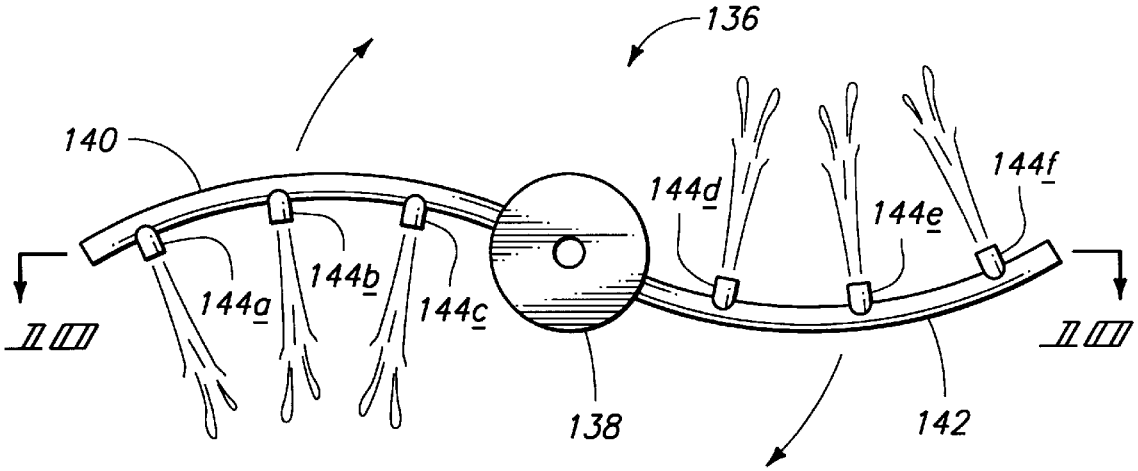
FIG. 9 is a bottom view of a first water effect called a "whirly bird."

FIGS. 9 and 10 illustrate a first water effect at 136 referred to herein as a "whirly-bird." Water effects are those devices which selectively drench participants in the ride but do not appreciably change the direction or speed of travel of the inner tubes as they move through the water ride. The whirly-bird water effect 136 includes a central body 138 from which a pair of radial arms 140,142 extend. Each of arms 140,142 includes a plurality of discharge jets (such as jets 144*a*–144*c* on arm 140 and jets 144*d*–144*f* on arm 142) coupled to a water source. The jets 144*a*–144*c* on arm 140 are generally pointed in an opposite direction from the jets 144*d*–144*f* on arm 142. Water forced out of the discharge jets causes the whirly-bird assembly to rotate thus flinging water out in a wide radius.

FIG. 10 shows a sectioned side elevation view of the whirly-bird water effect 136 mounted on the underside of a truss frame 146 spanning the width of the water play area 26 (see FIG. 1). The truss frame 146 is suspended above the play area a sufficient distance to allow participants within the inner tubes to pass safely underneath without colliding with the overhanging water effects hardware. The whirly-bird includes a feed pipe 148 along the rotational axis of the water effect coupled to a fixed feed pipe 150 within a leakproof bearing swivel collar 152. The bearing swivel collar 152 is attached to the underside of the truss frame 146 via bolts 154,156. A remote control button 158 located on master control panel is coupled to a pneumatic, hydraulic or electric valve 160 via leads 82. The valve 160 is interposed between a pressurized water source (not shown) and the water effect such that when the button is depressed by the spectator, the valve 160 opens to supply water to the whirly-bird water effect device and the device begins to rotate as water is forced out through the discharge jets. Any participant unlucky enough to be caught underneath the device 136 when activate is soaked.

Figure 11:
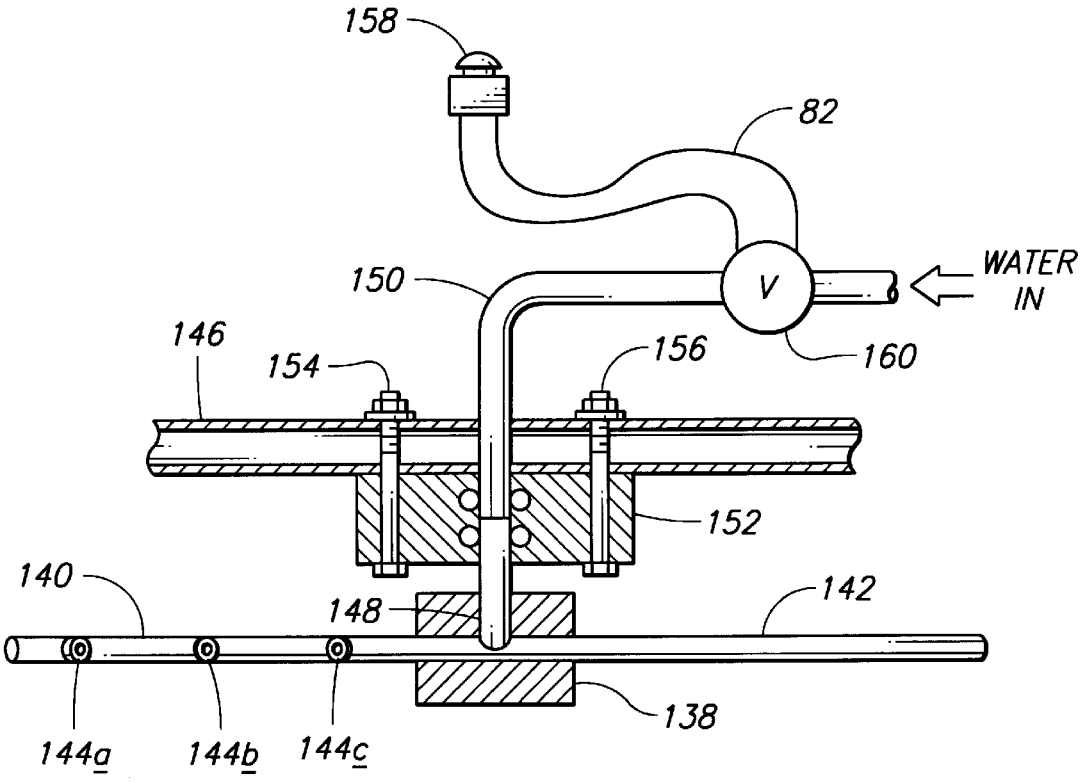
FIG. 11 is elevated side view of a second water effect called a "shower sprayer" mounted on an upper support member.
Figure 11:
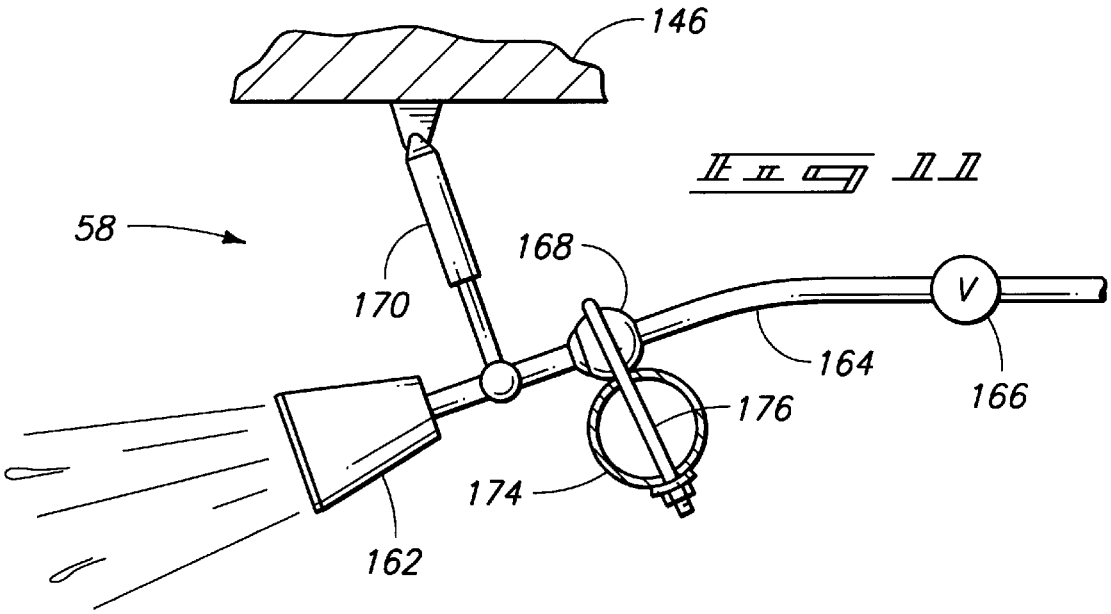
Figure 12:
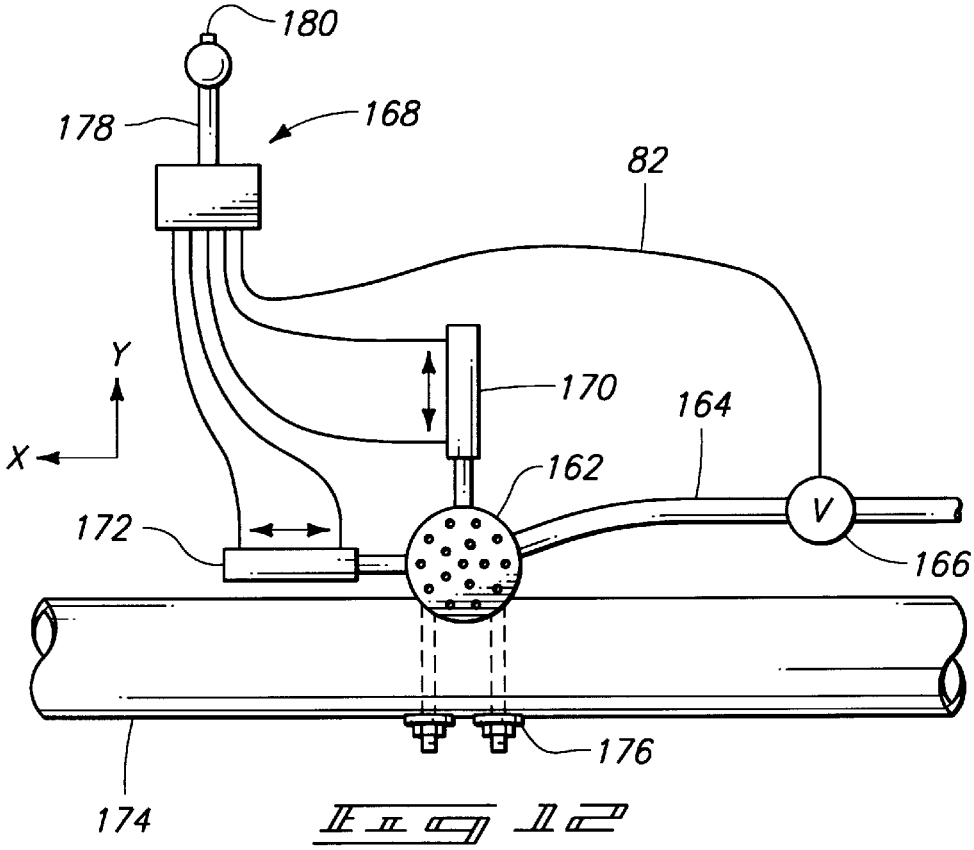
FIG. 12 is an underside view of the device of FIG. 11 shown coupled to an actuator.

FIGS. 11 and 12 illustrate a second type of water effect device at 58 referred to herein as a "shower sprayer." This device includes a shower head 162 fed through a hose 164 by a water source selectively supplied to the device via a valve 166. The valve 166 is opened by remote control via a controller 168 located at the master control panel and accessible by spectators. The hose 164 feeding the shower head 162 is fixed to a truss support member 174 via rigid fasteners 176. Adjacent to the shower head along the hose 164 at this fixed location is a ball joint 168 that allows the shower head to pivot in two dimensions, thereby changing the direction in which it is pointed. Hydraulic actuators 170,172 act to move the shower head in the y and x direction respectively responsive to control signals sent from the controller 168. Controller 168 is preferably a joystick-type pointing device that includes a stem 178 to designate x-y movement of the hydraulic actuators and a button 180 for activating valve 166.

Movement of the hydraulic actuators changes the direction in which the shower head is pointing. For instance, extending actuator 170 from the position shown in FIG. 11 bends the shower head 162 downward over support truss 174. Accordingly, a spectator can control the direction in which the shower sprayer device 58 is pointing in order to aim at designated target participants.

Figure 13:
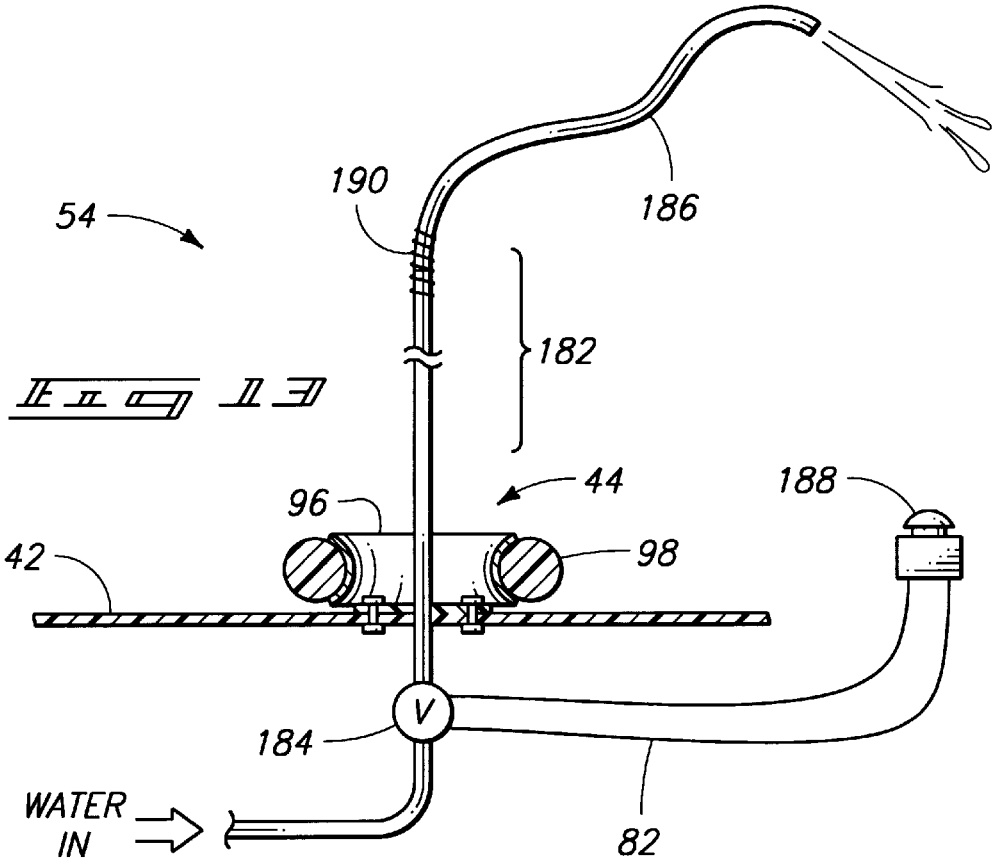
FIG. 13 is a side sectioned view of a third water effect called a "whipping snake" coupled to an actuator.

FIG. 13 is a third type of water effect device at 54 called a "whipping snake." The whipping snake includes a rigid tube riser 182 passing vertically through the sliding surface 42 of the water ride and coupled at a lower end to a pressurized water supply through a valve 184. Participants can be protected from colliding with and damaging the riser tube 182 by a stationary bumper 44 surrounding the tube and affixed to the sliding surface 42. A flexible tube 186 is coupled to the riser tube 182 and has a length approximately half that of the riser tube to reduce the chance that the flexible tube 186 will contact any of the participants on the water ride. It is preferred that the riser tube extends approximately twelve feet above the surface of the sliding surface 42 and that the flexible tube is approximately six feet long.

A remote control button 188, coupled to valve 184 via leads 82 and located at the master control panel, can be activated by a spectator to open valve 184. Such a button could not only turn the water effect device on and off but also effect the water pressure supplied to the device. Once the valve is open, pressurized water shoots upward through the riser tube 182 and out through flexible tube 186. Because tube 186 is flexible, water released through the tube forces the terminal end of the tube to thrash randomly from the force of the expelled water thereby scattering water in wildly random directions. A coil spring 190 is wrapped about the juncture between the riser tube and the flexible tube to improve the whipping action of the flexible tube when the device is activated. Use of such a spring 180 also improves the life of the flexible tube 186.

Figure 14:
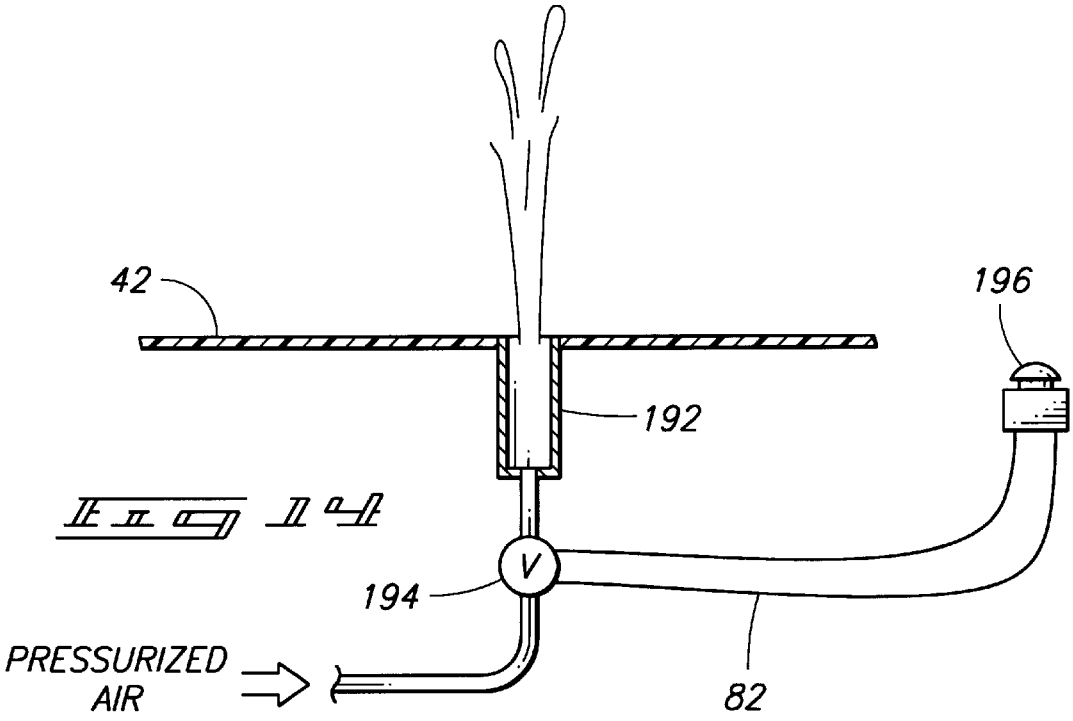
FIG. 14 is a side sectioned view of a fourth water effect called a "geyser."

FIG. 14 illustrates a fourth type of water effect device referred to as a "geyser". The geyser comprises a depression, such as cylindrical cup 192 sunk below the surface of the sliding surface 42, adapted to collect water within the depression. At the bottom of the depression is an aperture connected to a pressurized air source through a valve 194. Valve can be selectively opened when a spectator depresses button 196 coupled to the valve. When button 196 is depressed, compressed air is released into the bottom of the cylinder thus forcing the water to spray upward and outward like a geyser or landmine.

Figure 15:
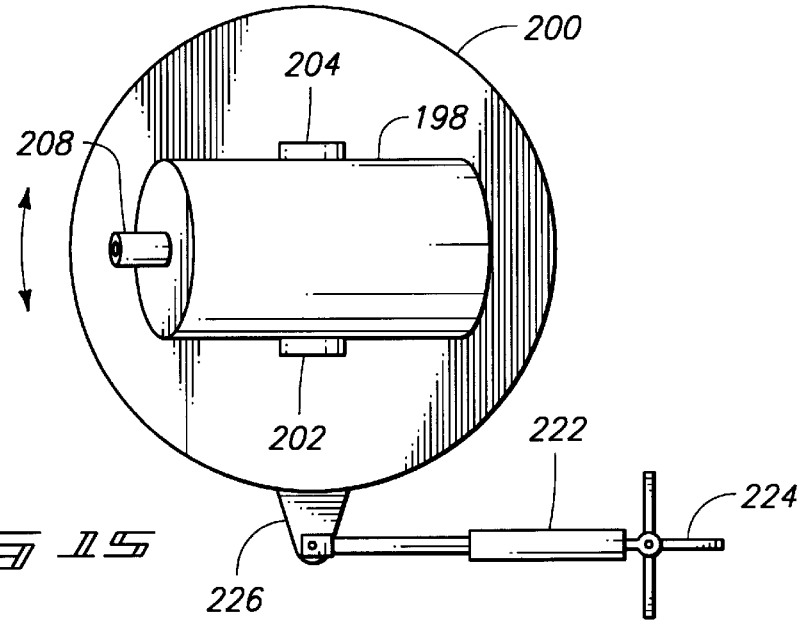
FIG. 15 is top view of a fifth water effect called a "water bomb launcher."
Figure 16:
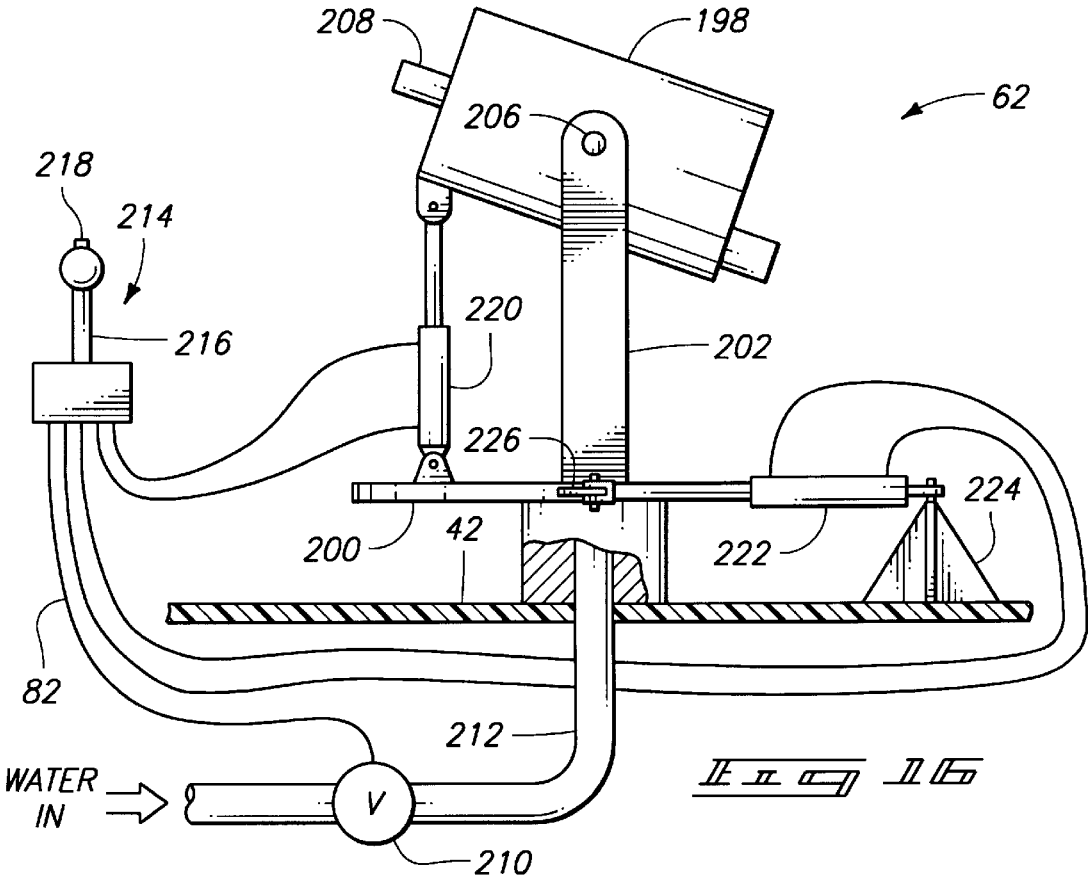
FIG. 16 is side elevation view of the device of FIG. 15 shown coupled to an actuator.

FIGS. 15 and 16 illustrate a fifth type of water effect device at 62 referred to herein as the "water bomb launcher." The water bomb launcher is adapted to project a coherent jet of water outward from a jet assembly 198, such as that manufactured by Georgia Fountain Company, Inc. of Tucker, Ga. The jet assembly 198 is mounted on a turntable 200 by support members 202,204 which suspend the jet assembly above the surface of the turntable. The turntable 200 is generally rotatable in a direction shown by the arrows in FIG. 15. Each support member is pivotally connected to the jet assembly 198, such as by pivot 206 on support member 202, to allow the jet assembly 198 and nozzle 208 to be titled upward and downward to affect the angle at which the water is projected. Water is selectively supplied by valve 210 to the jet assembly 198 through supply tube 212.

The direction in which the jet assembly 198 and nozzle 208 are pointed can be remotely controlled by controller 214 located at the master control panel for use by spectators outside the playing area. Controller 214 is preferably a joystick-type controller including a directional stem 216 and a button 218. The controller 214 is coupled via leads 82 to a pair of hydraulic actuators 220,222 which lengthen or shorten in response to signals received from the controller 214.

Actuator 220 is coupled between the turntable 200 and the front portion of the jet assembly 198 for pivoting the jet assembly about pivot 206 and thereby adjusting the upward angle at which the jet assembly projects the coherent stream of water out the nozzle 208. Actuator 220 is preferably moveable to allow the jet assembly to be pivotable through an arc of about 60 degrees.

Actuator 222 is coupled between a gusset 224 fixed to the sliding surface 42 and a flange 226 attached to the edge of turntable 200. As the actuator 222 lengthens and shortens in response to signals from controller 218, turntable 200 is rotated in a clockwise or counterclockwise direction. When rotated, the jet assembly 198 atop the turntable is turned in a direction desired by the spectator using the controller 218. Actuator 222 is preferably moveable to allow the jet assembly to be rotatable through an arc of about 90 degrees. When the jet assembly 198 is properly aimed by careful movement of actuators 220,222, the button 218 can be depressed to send a coherent stream of water toward unsuspecting participants within the play area.

Figure 17:
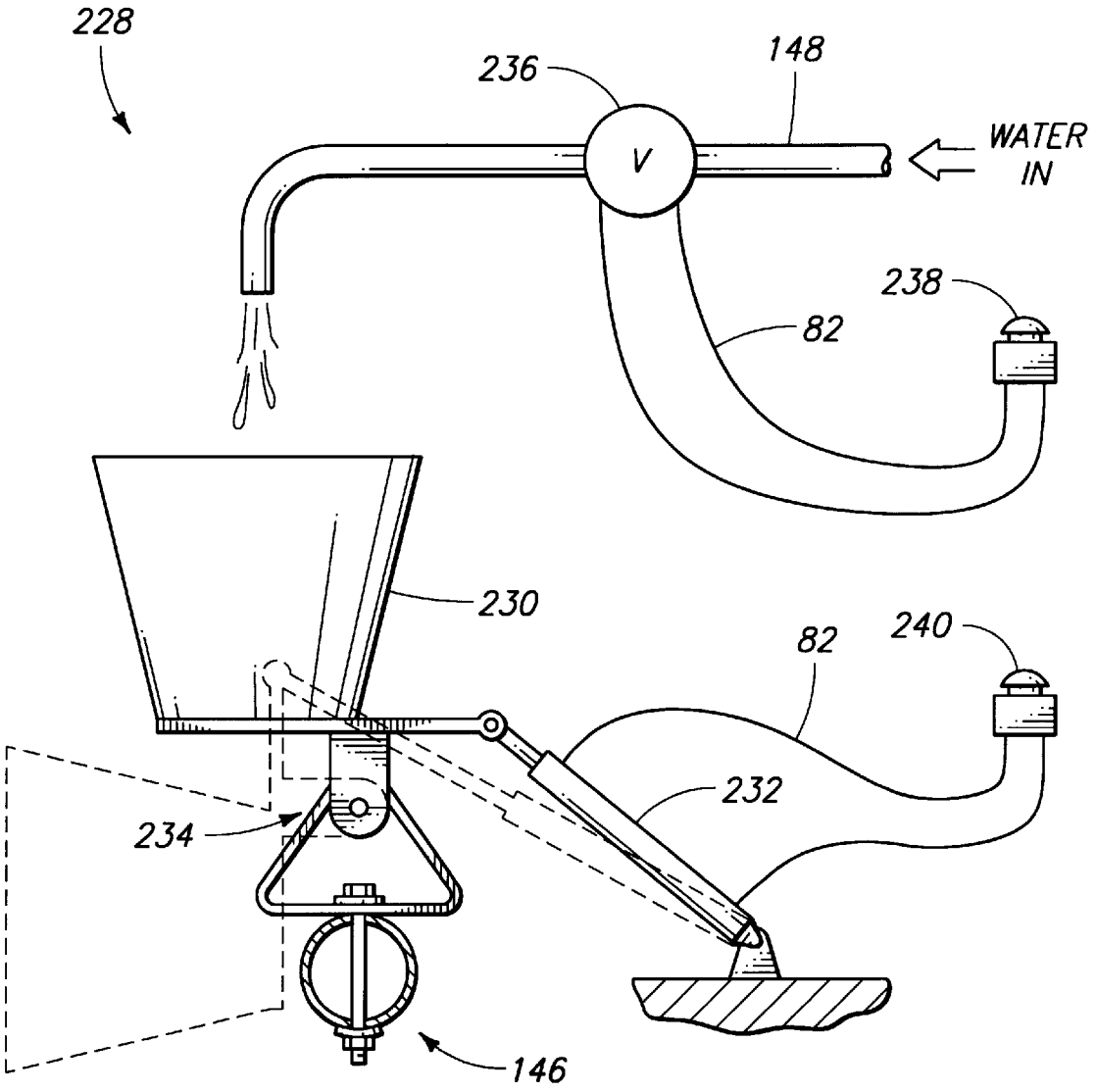
FIG. 17 is a side elevation view of a sixth water effect called a "tipping bucket" shown coupled to an actuator.

FIG. 17 illustrates a sixth embodiment of a water effect device at 228 referred to herein as a "tipping bucket." The tipping bucket is mounted to the truss frame 146 spanning the width of the water play area 26 (see FIG. 1). The truss frame 146 is suspended above the play area a sufficient distance to allow participants within the inner tubes to pass safely underneath without colliding with the overhanging water effects hardware. The tipping bucket device includes a container, such as bucket 230, and a pneumatic actuator 232 coupled to the container. The bucket is pivotable about a hinge assembly 234 from an upright position when the actuator 232 is retracted to a tipped position (shown in dashed outline) when the actuator 232 is extended.

The bucket 230 is fillable with water via a water supply pipe 148 coupled to a water source through valve 236. Valve 236 is selectively opened and closed by activation of a button 238 located remotely at the master control panel for use by a spectator. Button 238 is coupled to valve 236 by leads 82 and can be a simple two position switch which keeps the valve open or closed. Alternately, button 238 can be configured with a timing mechanism to open valve 236 for only a preselected amount of time, thus filling the bucket 230 a certain amount before shutting off the water supply.

A second button 240 is coupled to actuator 232 for extending the actuator and consequently tipping the bucket 230. When bucket 230 is pivoted to its tipped position, all water within the bucket is poured out. If activation of button 240 is properly timed, a spectator can drench participants within an inner tube passing below the tipping bucket 228.

Though not shown in detail in the drawings, another type of water effect shown in FIGS. 1 and 2 at 52 is called a "rain drop" and includes a vertical feed pipe forming the axis of a canopy suspended over the sliding surface 42. The canopy has an arcuate upper surface bounded by an edge. The feed pipe communicates water from a pressurized water source to the open top of the pipe whereupon the water flows out over the curved upper surface of the canopy and over the canopy edge to fall in a sheet onto the sliding surface of the play area. A valve coupled to the water feed pipe is actuatable by a button located in the spectator area to start or stop the flow of water over the edge of the canopy. In use, a participant would only be drenched when passing the boundary defined by the edge of the canopy. Otherwise, the participant is protected from the flow of water by the umbrella-like canopy overhead.

Use of the device will now be described with reference to FIG. 2 which illustrates as dashed lines two of many different paths which participants can take through the water ride. It is understood that the number of possible paths depends not only on the starting position within the start pool 24, but if and to what extent the movement inducing devices such as the flipper paddles 48 are activated by spectators. When you take into account the fact that a participant's inner tube can collide with any of the other inner tubes 60 moving within the play area, the number of possible paths within the play area becomes nearly infinite.

Referring first to path A, a group of participants within an inner tube move from the upper start pool 24 down the sloped surface 42. Spectators viewing the play area from the raised platform 32 notice that the inner tube is passing adjacent a geyser 56. The spectator controlling that geyser, though, pushes a button activating the geyser too late so that the geyser stream ricochets harmlessly off the underside of the tube as it passes over the geyser. For now, the participants within the inner tube remain dry. Another spectator activates flipper paddle 48 just at the proper moment to send the inner tube careening toward the whipping snake 54 which is kept on continuously by still another sadistic spectator. The inner tube quickly rebounds from the air-filled bladder surrounding the whipping snake but not before all participants in the inner tube closest the whipping snake are soaked. The inner tube then passes between the spinner 46 which imparts a spin to the inner tube as it is sent down toward another flipper paddle 48. Paddle 48 sends the inner tube toward the far wall 36; for now safely away from any water effect devices. An angled guide 50 along the wall 36 sends the inner tube back into play. A particularly nasty spectator manning the water bomb launcher 62 has been eyeing the inner tube and its occupants, thinking them too dry. After carefully aligning the water bomb launcher and aiming it in a direction he knew the inner tube must pass, he lets fly at the proper moment, thus sending a coherent stream of water arcing over the play area to land among all participants within the now spinning inner tube. Soon after, the inner tube passes partially under a rain drop 52. Those in the tube that pass across the boundary defined by the rain drop canopy are drenched—put in that position by the random spin imparted to the tube by the spinner 46 further up the play area. The end is in sight for the inner tube participants, but not before a spectator has filled the tipping bucket 228 with water and dumped its contents all over the now completely soaked participants. Entry into the lower splash pool 28 marks the end of the ride for now.

Participants moving along path B are a little bit luckier. Seeing what happened to the A group, group B chooses to push off from the start pool closer to wall 38. The geyser activated closest to them at the start of their ride is too far away to drench any of the inner tube participants. Their first encounter is with a flipper paddle 48 along wall 38. The flipper is activated a little too late thus sending the inner tube past the rain drop 52, another geyser and to another paddle 48. That paddle, when activated, sends the inner tube upslope toward a stationary bumper 44 from which it ricochets and moves into the dutchman's dike 116. The inner tube remains within the dutchman's dike as two more inner tubes move in behind it. As the water level builds up, a spectator presses a button at the master control panel thus sending the three inner tubes down the sloped surface 42 on a wave of water. The group B inner tube careens off of a stationary bumper 44 and toward wall 38. The tube then miraculously bounces off wall 38 to pass safely between a shower sprayer 58 and whirly bird 136 mounted underneath the truss frame 146 spanning the play area. The participants enter the lower splash pool virtually unscathed.

Having described and illustrated the principles of the invention in a preferred embodiment thereof, it should be apparent that the invention can be modified in arrangement and detail without departing from such principles. For instance, the buttons for activating the water effects and movement inducing devices could be located within the play area itself. We claim all modifications and variation coming within the spirit and scope of the following claims:

We claim:

1. A water amusement ride for use by a participant, the ride comprising:

a sloped play area;

a thin sheet of water along said sloped play area to reduce frictional forces acting on the participant as the participant moves along a path on the sloped play area;

a plurality of movement inducing devices located within said play area for modifying the movement of the participant within the play area to a different path, at least one of said movement inducing devices having actuation means located outside of the play area for manual activation by a spectator; and a plurality of water effects located within said play area for drenching participants within the play area, at least one of said water effects having actuation means located outside of the play area for manual activation by a different spectator, said plurality of movement inducing devices and water effects being arranged on said play area to allow substantially free two dimensional movement of a participant along any one of a plurality of paths on the play area from one of a plurality of start positions to one of a plurality of end positions so that the participant can have a substantially different experience each time the participant uses the water ride.

2. A method for engaging spectators within an interactive water ride comprising:

directing participants within a play area down a sloped surface from an upper start area to a lower end area, said play area including a plurality of features adapted to interact with the participants;

locating spectators outside of the play area;

said spectators selectively activating at least one of the plurality of features within the play area during the step of directing the participants down the sloped surface which, by its activation, affects the participants as the participants descend toward the lower end area; and after the spectators selectively activate at least one of the plurality of features, directing at least one of the spectators down the sloped surface.

3. The method according to claim 2, further including the step of providing a plurality of actuators outside of said play area, and coupling each of said actuators to one of said features within the play area, for selective activation of the feature by the spectator.

4. The method according to claim 3, further including the step of drenching participants within the play area responsive to the step of selectively activating at least one of the features within the play area.

5. The method according to claim 3, further including the step of redirecting the participants down the sloped surface responsive to the step of selectively activating at least one of the features within the play area.

6. The method according to claim 2, further including the step of allowing at least one of the participants to activate at least one of the plurality of features as the spectator is directed down the sloped surface.

7. An interactive amusement ride comprising:

a play area allowing substantially free two dimensional movement of a participant on the play area; and movement inducing means located within said play area for modifying the movement of the participant within the play area, at least one of said movement inducing means having actuation means located in the play area for selective activation by the participant or a spectator.

8. A water amusement ride for participants comprising:

an upper start area having a plurality of start positions;

a lower end area;

a generally sloped play area coupled between the upper start area and lower end area allowing substantially free two-dimensional movement of the participants from the upper start area to the lower end area thereby resulting in a plurality of possible paths along the play area; and movement inducing means for selectively modifying movement of the participants within the play area so that any one of the plurality of start positions can result in the participant exiting the play area at any one of a plurality of different lower area end positions.

9. The ride of claim 8, wherein the movement inducing means includes an elongate body adapted to contact a participant within the play area, said body being pivotable through an arc responsive to an actuator.

10. The ride of claim 8, wherein the participants are mounted within a circular vehicle adapted to traverse the play area, wherein the movement inducing device includes:

a first surface; and a second circular surface centered about a second axis and spaced from said first surface by a distance slightly smaller than a diameter of said circular vehicle, said second circular surface adapted to impart a spin to said circular vehicle as said vehicle passes between said first and said second surfaces.

11. The ride of claim 10, wherein said first surface is circular centered about a first axis and said second surface is circular centered about a second axis, said first surface being rotated about said first axis in a first direction at a first rate and said second surface being spun about said second axis at a second rate in a second direction opposite said first direction.

12. The ride of claim 11, wherein the first rate of rotation of the first circular surface is equal to the second rate of rotation of the second circular surface.

13. The ride of claim 11, wherein the first rate of rotation of the first circular surface is different from the second rate of rotation of the second circular surface.

14. The ride of claim 8, wherein the movement inducing device includes:

a holding area adapted to admit participants from an upstream side of the device; and a door located adjacent a downstream side of the device, said door being adapted to collect water within the holding area when the door is in a first closed position and, in a second open position, releasing said water and said participants within said holding area.

15. A water amusement ride adapted to allow spectator interaction with participants within the water ride comprising:

a play area of the water ride;

a plurality of devices located within the play area that interact with the participants within the play area;

a spectator area located outside of the play area;

a plurality of manually controlled actuators for operating the plurality of devices, said actuators being located within the spectator area in spaced apart relation to one another so that they cannot all be manually actuated simultaneously by a single person, wherein one of said devices includes:

a rigid riser tube coupled to a water source;

a valve coupled between the riser tube and the water source; and a flexible tube coupled to an end of the rigid riser tube.

16. A water amusement ride adapted to allow spectator interaction with participants within the water ride comprising:

a play area of the water ride;

a plurality of devices located within the play area that interact with the participants within the play area;

a spectator area located outside of the play area;

a plurality of manually controlled actuators for operating the plurality of devices, said actuators being located within the spectator area in spaced apart relation to one another so that they cannot all be manually actuated simultaneously by a single person, wherein one of said devices includes:

a canopy suspended above the play area and coupled to a water source, said canopy including an arcuate upper surface bounded by a terminal edge; and a valve coupled between the canopy and the water source, wherein said valve is opened when the actuator is activated by the spectator thus directing water out over the upper surface of the canopy toward the canopy terminal edge.

17. A water amusement ride adapted to allow spectator interaction with participants within the water ride comprising:

a play area of the water ride;

a plurality of devices located within the play area that interact with the participants within the play area;

a spectator area located outside of the play area;

a plurality of manually controlled actuators for operating the plurality of devices, said actuators being located within the spectator area in spaced apart relation to one another so that they cannot all be manually actuated simultaneously by a single person, wherein one of said devices includes:

a water jet assembly capable of projecting a coherent stream of water; and means for aiming the waterjet assembly in a direction selected by a control means operable by a spectator.

18. The water amusement ride of claim 17, wherein said means for aiming include:

a first actuator for tilting said water jet assembly upward and downward;

a turntable upon which said water jet assembly is mounted; and a second actuator coupled to said turntable for rotating said turntable across an arc selected by said spectator using said control means.

19. A water amusement ride adapted to allow spectator interaction with participants within the water ride comprising:

a play area of the water ride;

a plurality of devices located within the play area that interact with the participants within the play area;

a spectator area located outside of the play area;

a plurality of manually controlled actuators for operating the plurality of devices, said actuators being located within the spectator area in spaced apart relation to one another so that they cannot all be manually actuated simultaneously by a single person, wherein one of said devices includes:

a container located below a surface of the play area, said container being adapted to collect water flowing across said play area surface;

a nozzle located at a lower portion of the container; and a valve coupled between the nozzle and a pressurized air source, wherein said valve is opened when the actuator is activated by the spectator thus directing air out of the nozzles and inducing water within the container to forcibly ejected from the container.

20. A water amusement ride adapted to allow spectator interaction with participants within the water ride comprising:

a play area of the water ride;

a plurality of devices located within the play area that interact with the participants within the play area;

a spectator area located outside of the play area;

a plurality of manually controlled actuators for operating the plurality of devices, said actuators being located within the spectator area in spaced apart relation to one another so that they cannot all be manually actuated simultaneously by a single person, wherein one of said devices includes:

a set of nozzles pointed in a first direction mounted on a first arm;

a second set of nozzles pointed in a second direction mounted on a second arm, said first and second arm being rotatable about a common axis; and a valve coupled between the first and second set of nozzles and a water source, wherein said arms rotated about said common axis when said valve is open.

21. A water amusement ride adapted to allow spectator interaction with participants within the water ride comprising:

a play area of the water ride;

a plurality of devices located within the play area that interact with the participants within the play area;

a spectator area located outside of the play area;

a plurality of manually controlled actuators for operating the plurality of devices, said actuators being located within the spectator area in spaced apart relation to one another so that they cannot all be manually actuated simultaneously by a single person, wherein one of said devices includes:

a bucket suspended over the play area, said bucket being moveable between a first upright position and a second tipped position;

an actuator coupled to the bucket for moving said bucket from said first position to said second position;

a conduit for carrying water from a water supply to said bucket when the bucket is in the first upright position; and a valve coupled between the conduit and the water supply.

* * * * *